United States Patent [19]

Morita

[11] 4,021,107

[45] May 3, 1977

[54] ELECTROPHOTOGRAPHIC DUPLICATION METHOD AND APPARATUS THEREFOR

[75] Inventor: Shizuo Morita, Hachioji, Japan

[73] Assignee: Konishiroku Photo Industry Co., Ltd., Tokyo, Japan

[22] Filed: May 30, 1975

[21] Appl. No.: 582,374

[30] Foreign Application Priority Data

May 31, 1974 Japan ..... 49-62075

[52] U.S. Cl. ..... 355/3 R; 355/11

[51] Int. Cl.[2] ..... G03G 15/00

[58] Field of Search ..... 355/3 R, 3 FU, 17, 8, 355/3 DD, 11; 118/637; 432/59, 60

[56] References Cited

UNITED STATES PATENTS

| | | | |
|---|---|---|---|
| 3,775,711 | 11/1973 | Burgess et al. | 355/100 |
| 3,792,964 | 2/1974 | Chatterji | 355/11 X |
| 3,809,474 | 5/1974 | Mihalik | 355/11 |
| 3,867,031 | 2/1975 | Hakanson | 355/78 |

*Primary Examiner*—R. L. Moses

*Attorney, Agent, or Firm*—Bierman & Bierman

[57] ABSTRACT

Method and apparatus for electrophotographic duplication comprising a light source used for illuminating an original and fixing an image on a transfer sheet, and means for directing the available illumination from the light source first to the illumination station and then to the fixing station. Means are also provided for deenergizing the light source during the period between illumination and fixing and for reenergizing the light source prior to fixing.

8 Claims, 5 Drawing Figures

ELECTROPHOTOGRAPHIC DUPLICATION METHOD AND APPARATUS THEREFOR

This invention relates to a technique of fixing a toner image on a photosensitive body or on a transfer sheet onto which an image is transferred from a photosensitive body, by making use of a light source destined for illumination of an original as a heating source.

In general, methods of fixing a transfer sheet having a toner image thereon are classified into two. One of the methods is a fixing method in which the transfer sheet is passed by a metallic heating plate incorporating a heating unit such as a resisitance wire serving as a heating source, which heating plate is heated by conduction of an electric current in the heating unit. The other of the methods is a direct fixing method in which the transfer sheet is passed under pressure through between a pair of rotatable rollers which are heated by an associated heating unit. These are ordinary methods of fixing a toner image for a copying machine using a dry process.

In the methods, use is normally made of an electric heating wire as a heating unit which serves to heat a metallic plate or a pair of rotatable rollers acting as a fixing heater. In order to enable the toner image on the transfer sheet to be fixed, the heater must be normally at the temperature of 180° C or so and it is necessary to maintain the fixing device at the temperature of 180° C or so whenever it is desired to put the copying machine ready for use. This means that, since several minutes are required for the heating unit to reach the temperature necessary for fixing after conduction of an electric current in the heating wire, it is impossible to effect the fixing of the transfer sheet just after electric conduction is cut off in the fixing device so that it is cooled. It is therefore necessary to keep the fixing device at a predetermined constant temperature in order to put the copying machine ready for use all the time. However, electric power ranging from 500 W to 1 KW is needed to heat the fixing device to the temperature of 180° C or so at all times and an extreme amount of electric power is consumed even with a temperature adjusting device intended to maintain the fixing device at a constant temperature. It is also to be noticed that heat dissipation from the fixing device has adverse effects on the components of the device and/or the device itself.

The present invention is intended to remove these drawbacks inherent to the conventional fixing techniques. The invention is characterized by reduction in number of duplicating steps by use of a light source destined to operate only in the exposing step also in the fixing step with the aid of an angularly displaceable reflector. According to the invention, arrangement is made such that a light source or an illumination lamp intended to illuminate an original directs its light path to the exposure station for normal exposure of the original at exposure time while the lamp changes its light path from the exposure station to the fixing station for fixing so that a toner image on the transfer sheet which has been made visible from the latent image formed by the light exposure is heated to such high temperature as to be melted. Upon completion of the fixing fo the toner image, the illumination lamp may be put out. The illumination lamp is normally of the type of high brightness and produces radiation of heat of high temperature and so a part of a body, when subjected to such radiated heat, reaches the temperature of 100° C in a short time. Thus, the lamp of this type can successfully be used as a heating unit.

The present invention will now be described in more detail by reference to the accompanying drawings illustrating embodiments of the invention in which.

Figure 1:
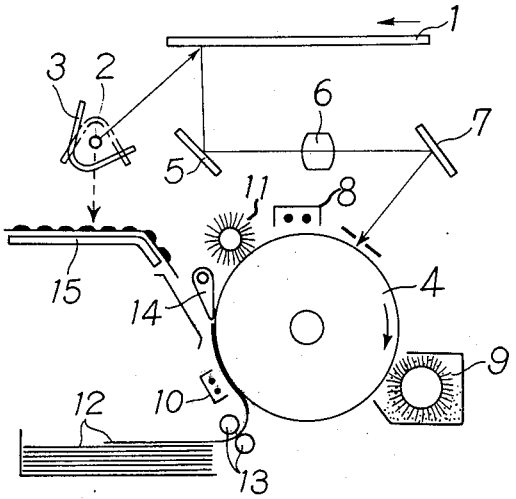
FIG. 1 shows schematically an electrophotographic system as a whole.

Referring now to FIG. 1 of the drawings, there is provided at the top of the copying machine a horizontally reciprocable mount 1 made of a transparent glass plate on which an original is placed. The original is subjected to illumination from a light source 2 which has a reflector 3 rotatably displaceable with respect thereto. The light emitted from the light source 2 is reflected on the original on the mount 1 and led onto a photosensitive body 4 through a reflection mirror 5, a lens 6 and another reflection mirror 7. Along the periphery of the photosensitive body 4, there are provided a corona charging electrode 8, a developing device 9, a transfer electrode 10 and a cleaning rush 11. These components may be of conventional type and no further details are given. Some transfer sheets 12 is stored in a cassette and fed into between the photosensitive body 4 and the transfer electrode 10 by means of a pair of feed rollers 13 for transfer of a toner image on the sheet. A separator pawl 14 is provided downstream of the transfer electrode 10 for separating the transfer sheet 12 from the photosensitive body 4 just after transfer of the image onto the transfer sheet 12 is completed. The transfer sheet 12 with the toner image is carried to a fixing guide plate 15 where the sheet 12 is subjected to fixing treatment.

Now in operation, a proper original is put on the mount 1 and moved in the direction indicated by an arrow in FIG. 1 while being subjected to illumination by the light source 2. At the same time, the photosensitive body 4 is rotated clockwise in synchronism with the movement of the original. The photosensitive body 4 is exposed in the same sequence as the illumination of the original by the light source 2 through the reflection mirror 5, the lens 6 and the reflection mirror 7. The photosensitive body 4 is subjected to electric charging by the corona charging electrode 8 prior to exposure by the light reflected on the reflection mirror 7 and the exposure causes an electrostatic latent image to be formed on the surface of the photosensitive body 4. This latent image is then developed with the aid of toner particles by the developing device 9 so that a toner image is produced on the photosensitive body 4. The transfer sheet 12 is fed onto the surface of the photosensitive body 4 by the feed rollers 13 and the toner image carried on the photosensitive body 4 is transferred to the transfer sheet 12 with the air of the transfer electrode 10. The sheet 12 having the toner image thus transferred is separated from the surface of the body 4 by means of the separator pawl 14.

Hereupon, the reflector 3 for light source 2 is turned into the position indicated by an imaginary line in FIG. 1 and the light source 2 is put on again so that the transfer sheet 12 on the fixing guide plate 15 is subjected to concentrated illumination from the light source 2 in cooperation with the angularly displaced reflector 3 so as to be fixed by heating or thermal spectrum. The reflector 3 may be angularly displaced or turned by a conventional means such as a cam or an electromagnetic mechanism (not shown) actuated in synchronism with the rotation of the photosensitive body 4 or the operation of the separator pawl 14.

Figure 2:
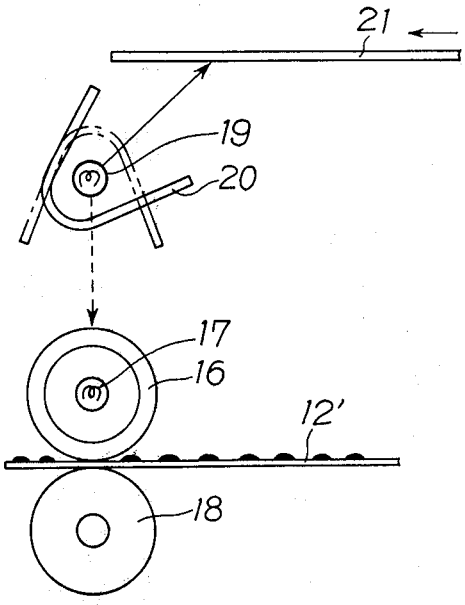
FIGS. 2 through 5 show different embodiments of the fixing devices achieving the present invention.

FIG. 2 shows an embodiment of the fixing device realizing the so-called indirect fixing method according to the present invention in which two light sources are used and which differs from the direct fixing method of the embodiment shown in FIG. 1. A fixing roller 16 is made of a metal body covered with materials such as Teflon which is thermally stable and non-sticky, and has an auxiliary heating unit 17 incorporated therein. Another roller 18 is located just below the fixing roller 16 for pressing the transfer sheet 12′ therebetween. Above the fixing roller 16 is located a light source 19 having a reflector 20 angularly displaceable with respect thereto. The light source 19 is so arranged as to be able to illuminate both the mount 21 made of a transparent glass plate on which an original is placed and the fixing roller 16.

With the embodiment of FIG. 2 arranged as above mentioned, the mount 21 with a proper original thereon is moved in the direction of an arrow while being subjected to concentrated illumination sequentially by the light source 19 with the reflector 20 taking the position indicated by a solid line in FIG. 2, so that the photosensitive body is exposed to the light reflector on the original as mentioned hereinbefore with respect to FIG. 1. Then the latent image on the surface of the photosensitive body is developed and the toner image thus produced is transferred to the transfer sheet 12′ which is in turn brought into between the fixing roller 16 and the pressure roller 18. At this time, the reflector 20 associated with the light source 19 is turned towards the fixing roller 16 or from the position indicated by a solid line to that indicated by an imaginary line and the light source 19 is lit again so that the light is directed onto the surface of the fixing roller 16 by the reflector 20 to heat it. The fixing roller 16 is always preheated by the auxiliary heating unit 17 located inside the roller 16 while the roller 16 has rapidly increasing temperature owing to intensive illumination by the light source. As a result, the roller 16 rapidly reaches the fixing temperature and remains at this temperature. Under such condition, the transfer sheet 12′ is brought into between the fixing roller 16 and the pressure roller 18.

Figure 3:
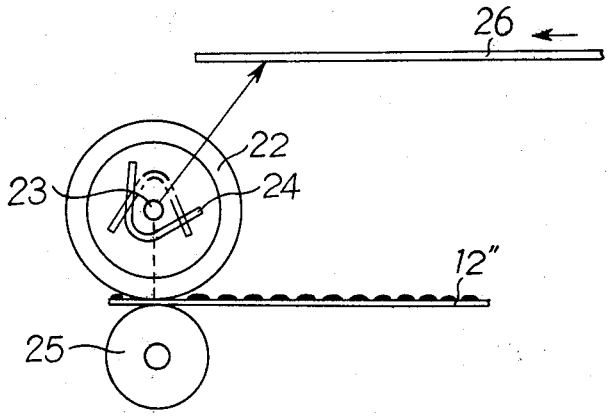

FIG. 3 shows another embodiment of the fixing device according to the present invention in which a light source of exposure is used for fixing purpose. A transparent rotatable cylindrical body 22 is made of materials such as crystal glass and has a light source 23 and an associated reflector 24 rotatably mounted therearound, both incorporated in the cylindrical body 22. A pressure roller 25 is located against the fixing cylindrical body 22. A mount 26 on which an original is to be placed is made of a transparent glass plate and is adapted to move in the direction of an arrow in FIG. 3. A reference numeral 12″ designates a transfer sheet.

Operation of the fixing device shown in FIG. 3 will be described below. The original carrying mount 26 is moved in the direction of an arrow while being illuminated by the light emitted by the light source 23 and passed through a part of the transparent cylindrical body 22 with the aid of the reflector 24, so that the photosensitive body is exposed by the illumination as described, with reference to FIG. 1. The photosensitive body thus exposed is then developed and a toner image is transferred to the transfer sheet 12″ which is in turn brought into between the rotating cylindrical body 22 and the pressure roller 25. At this instance, the reflector 24 for the light source 23 is turned from the position indicated by a solid line to that of an imaginary line in FIG. 3 and the light source 23 is lit again so that the fixing station is heated by the light emitted by the light source 23 located inside the cylindrical body 22 and directed by the reflector 24. The transfer sheet 12″ is directly heated through the fixing cylindrical body 22 by the heat source 23 and the cylindrical body 22 itself which is preheated with the result that fixing efficiency is highly increased. It is of course possible to make use of thermal spectrum as in the embodiment of FIG. 1.

Figure 4:
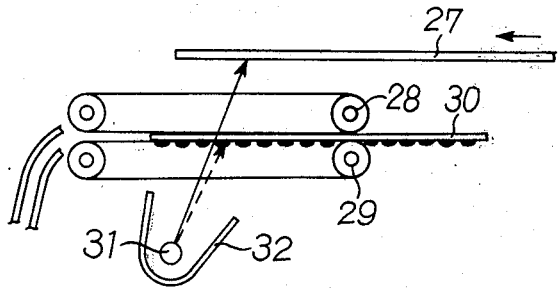

Reference is further made to the embodiment of FIG. 4. An original carrying mount 27 is made of a transparent glass plate. A pair of conveyor devices 28 and 29 are located below the original carrying mount 27 adjacent to each other so that the transfer sheet 30 is conveyed therebetween in parallel to the mount 27. A light source 32 is intended to illuminate the original and has an associated reflector 32.

In operation, a proper original is placed on the mount 27 which is then moved in the direction of an arrow in FIG. 4 while being subjected sequentially to exposure by the light source 31. In the similar manner, the transfer sheet 30 having a toner image on its lower side carried into the pair of conveyor devices 28 and 29. When the transfer sheet 30 commences to be carried while being pinched by the pair of conveyor devices 28 and 29, the light source is again lit so that the surface of the transfer sheet 30 on which the toner image bears is heated and the image is fixed. It is to be noted that images to be fixed need not necessarily be the one treated one by one in the preceding process. This embodiment differs from the embodiments above described in that the reflector for the light source is not adapted to be angularly displaced. However, arrangement may be made such that the reflector is shifted at the time of fixing so that the path of the bundle of light emitted from the light source 31 is changed to strike on the transfersheet 30. It is also possible to make arrangement that the original bearing mount 27 is fixed and the light source 31 is moved along the surface of the mount 27 to illuminate the original.

Explanation is given to the embodiment of

Figure 5:
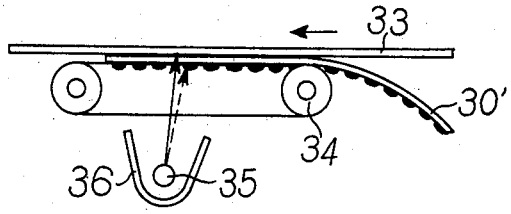

FIG. 5 which is a modification of the embodiment of FIG. 4.

An original carrying mount 33 is made of a transparent glass plate and a conveyor 34 is located underneath the mount 33 which serves to fix the transfer sheet 30′. A light source 35 is intended to illuminate the original and has an associated reflector 36.

Operation will be as follows. A proper original is placed on the original carrying mount 33 which is moved in the direction of an arrow in FIG. 5 while being illuminated by the light source 35. The photosensitive body is exposed in the same manner as described with respect to FIG. 1 and a toner image is transferred to a transfer sheet 30′. The transfer sheet 30′ with the toner image on its lower side is brought into between the original carrying mount 33 in its starting position and the conveyor 34 and is carried towards the fixing station. When the transfer sheet 30′ is carried, the original carrying mount 33 remains stationary and therefore should preferably be spaced from the conveyor 34. While the transfer sheet 30′ is carried, the light source 35 is lit again so that the surface of the paper 30′ on which the toner image bears is illuminated for fixing. In this embodiment, the transfer sheet 30′ passes just beneath the original carrying mount 33 where the brightness is highest, and high heating temperature of intensive thermal spectrum results in good efficiency of fixing.

In the embodiments shown in FIGS. 4 and 5, the light sources 31 and 35 are illustrated as stationary. In case they are used not only for illumination but also for fixing or heating, their position may be changed in accordance with the angular movement of the reflectors so as to increase efficiency.

As described above, the present invention is characterized in that a light source destined for exposure is turned to effect fixing with thermal rays emitted therefrom, and is achieved by the procedure that a reflector associated with the light source is directed to the original to be illuminated at the time of exposure and, after completion of illumination of the original, the direction of illumination of the light source is turned to a fixing station and the light source is lit again so that the heat emitted therefrom is used for fixing. Alternatively, the reflector may be fixed and the transfer sheet, after being transferred, is carried to the exposure station where the toner image on the paper is fixed. This results in that there is no need to provide a fixing station separately from an exposure station and the whole structure of the copying machine is simplified. The copying machine is fabricated in a small size and power consumption is minimized. In the present invention, the thermal rays can be effectively converged by a reflector which is effective to change the direction of illumination of a light source.

While the embodiments have been described with respect to the electrophotographic duplication system of the kind shown in FIG. 1 wherein the developed toner image is transferred to a transfer sheet at the tranfer station, the present invention is also applicable to a duplication system wherein a transfer sheet is not used, that is, an electrostatic latent image is formed directly on a photosensitive body such as a photosensitive sheet and the latent image is developed and then fixed on the sheet. In this kind of system, the cleaning brush 11 and the transfer electrode 10 are dispensed with and a photosensitive body such as a photosensitive sheet is fed to an exposure station and the photosensitive body 4 is replaced by a rotatable drum.

What we claim is:

1. An electrophotographic duplication method comprising the steps of illuminating information on an original to be duplicated by a light source at an illuminating station, directing the available illumination to said illumination station, exposing a photosensitive surface to the light representative of said information to form an electrostatically latent image on said surface, deenergizing said light source after illumination is complete, developing said electrostatic latent image to render said image visual, conveying said visual image to a fixing station and reenergizing said light source and directing the available illumination to said fixing station, thermally fixing said visual image at the fixing station via the heat generated by said light source.

2. The electrophotographic duplication method as set forth in claim 1 further including the step of transferring said visual image on the photosensitive surface to a transfer sheet prior to the step of developing the said electrostatic latent image.

3. The electrophotographic duplication method as set forth in claim 1 further comprising the step of providing an auxiliary light source for preheating said fixing station.

4. The electrophotographic duplication method according to claim 1 wherein the light source is partially surrounded by a nontransparent reflector further comprising the step of moving the reflector between a first position in which the reflector directs the available illumination to the illumination station when illumination is required and a second position in which the reflector directs the available illumination to the fixing station when fixing at the fixing station is required.

5. A copying machine comprising a horizontally reciprocable original carrying mount, a light source equipped with a reflector for illuminating information carried on said original, a photosensitive body for forming an electrostatic latent image representative of said information, means for developing said latent image to render said image visual, means for transferring said visual image on said photosensitive body to a transfer sheet, and means for conveying said transfer sheet to a fixing station, said fixing station being located opposite said original carrying amount with respect to said light source and said reflector is angularly displaceable with respect to the light source to heat said transfer sheet at the fixing station, said fixing station comprising pressure rolls between which the sheet bearing the image to be fixed passes, one of said rolls being transparent, said light source and reflector being mounted inside of said transparent roll.

6. A copying machine comprising a horizontally reciprocable original carrying mount, a light source equipped with a reflector for illuminating information bearing on said original, a photosensitive body forming an electrostatic latent image representative of said information, means for developing said latent image to render said image visual, means for transferring said visual image on said photosensitive body to a transfer sheet and means for conveying said transfer sheet to a fixing station, said fixing station comprising an endless belt for carrying the transfer sheet, said fixing station being located on the same side as said original carrying amount with respect to said light source and said visual image is transferred on the side of the transfer sheet facing said light source, said light source being partially surrounded by a fixed reflector, said light source first illuminating the original and then the transfer sheet as the transfer sheet passes between the light source and the original mount.

7. The copying machine according to claim 6 wherein the endless belt is closely adjacent the original mount, said transfer sheet being maintained in close contact with the endless belt and original mount during fixing.

8. An electrophotographic duplication method comprising the steps of illuminating information on an original to be duplicated by a light source at an illuminating station, directing the available illumination to said illumination station, exposing a photosensitive surface to the light representative of said information to form an electrostatically latent image on said surface, deenergizing said light source after illumination is complete, developing said electrostatic latent image to render said image visual, conveying said visual image to a fixing station and reenergizing said light source and directing the available illumination to said fixing station, thermally fixing said visual image at the fixing station via the heat generated by said light source and shifting said light source from a first position in which the light source is used for illumination of the original to a second position in which the light source is used to illuminate the fixing station.

* * * * *